US007170473B2

(12) United States Patent
Lee

(10) Patent No.: US 7,170,473 B2
(45) Date of Patent: Jan. 30, 2007

(54) PDP DRIVING DEVICE AND METHOD

(75) Inventor: Joo-Yul Lee, Ahsan (KR)

(73) Assignee: Samsung SDI Co., Ltd., Suwon (KR)

( * ) Notice: Subject to any disclaimer, the term of this patent is extended or adjusted under 35 U.S.C. 154(b) by 272 days.

(21) Appl. No.: 10/602,730

(22) Filed: Jun. 25, 2003

(65) Prior Publication Data

US 2004/0012547 A1 Jan. 22, 2004

(30) Foreign Application Priority Data

Jul. 16, 2002 (KR) ..... 10-2002-0041530

(51) Int. Cl.
*G09G 5/00* (2006.01)
*G09G 3/28* (2006.01)

(52) U.S. Cl. ..... 345/68; 315/169.4

(58) Field of Classification Search ..... 345/168, 345/204–205, 208–210, 55, 58, 60–72; 315/169.4, 315/169.1, 169.3

See application file for complete search history.

(56) References Cited

U.S. PATENT DOCUMENTS 6,617,802 B2 * 9/2003 Roh ..... 315/169.4

FOREIGN PATENT DOCUMENTS

JP 2001-228821 8/2001

* cited by examiner

*Primary Examiner*—Amr A. Awad
*Assistant Examiner*—Stephen Sherman
(74) *Attorney, Agent, or Firm*—H.C. Park & Associates PLC

(57) ABSTRACT

A device for driving a PDP for arranging scan electrodes and sustain electrodes in parallel for each display line, and arranging address electrodes to be crossed with the scan electrodes and the sustain electrodes. The device has a first switch and a second switch that are coupled in series between a first voltage and a second voltage, a capacitor coupled between a contact point of the first switch and the second switch and a third voltage. A rising ramp switch for forming a constant current is coupled to the third voltage at a first end of the rising ramp switch; and a main path switch is coupled between the contact point of the first and second switches and another end of the rising ramp switch, for forming a constant current.

11 Claims, 13 Drawing Sheets

PDP DRIVING DEVICE AND METHOD

CROSS REFERENCE TO RELATED APPLICATION

This application is based on Korea Patent Application No. 2002-41530 filed on Jul. 16, 2002, the content of which is fully incorporated herein by reference.

BACKGROUND OF THE INVENTION

1. Field of the Invention

The present invention relates to a PDP (plasma display panel) driving method and device.

2. Description of the Related Art

Recently, LCDs (liquid crystal displays), FEDs (field emission displays), and PDPs have been actively developed. PDPs have wider view angles and better luminance and light emission efficiency than other types of flat panel devices. Therefore, PDPs have come into the spotlight as substitutes for the conventional CRTs (cathode ray tubes) for large displays of greater than 40 inches.

A PDP is a flat display that uses plasma, which is generated via a gas discharge process, to display characters or images, and tens to millions of pixels are provided thereon in a matrix format, depending on its size. PDPs are categorized into DC PDPs and AC PDPs, according to the supplied driving voltage waveforms and discharge cell structures.

Since DC PDPs have electrodes that are exposed in the discharge space, DC PDPs allow the current to flow in the discharge space while the voltage is supplied, and therefore they problematically require resistors for current restriction. On the other hand, since AC PDPs have electrodes that are covered by a dielectric layer, capacitances are naturally formed to restrict the current, and the electrodes are protected from ion shocks in the case of discharging. Accordingly, AC PDPs have a longer lifespan than DC PDPs.

As shown in FIG. 1, in an AC PDP a scan electrode 4 and a sustain electrode 5, which are disposed over a dielectric layer 2 and a protection film 3, are provided in parallel and form a pair with each other under a first glass substrate 1. A plurality of address electrodes 8 covered with an insulation layer 7 are installed on a second glass substrate 6. Barrier ribs 9 are formed on the insulation layer 7 between the address electrodes 8. The barrier ribs are parallel with the address electrodes 8, and phosphor 10 is formed on the surface of the insulation layer 7 between the barrier ribs 9. The first glass substrate 1 and the second glass substrate 6 have a discharge space 11 between them and face each other so that the scan electrode 4 and the sustain electrode 5 may respectively cross the address electrode 8. The address electrode 8 and a discharge space 11 formed at a crossing part of the scan electrode 4 and the sustain electrode 5 form a discharge cell 12.

As shown in FIG. 2, the PDP electrode has an m×n matrix configuration. The PDP electrode, it has address electrodes A1 to Am in the column direction, and scan electrodes Y1 to Yn and sustain electrodes X1 to Xn in the row direction, alternately. The discharge cell 12 shown in FIG. 2 corresponds to the discharge cell 12 shown in FIG. 1.

In general, a method for driving the AC PDP includes a reset period, an addressing period, and a sustain period.

In the reset period, the states of the respective cells are reset in order to smoothly address the cells. In the addressing period, the cells that are turned on and the cells that are not turned on in a panel are selected, and wall charges are accumulated to the cells that are turned on (i.e., the addressed cells). In the sustain period, discharge is performed in order to actually display pictures on the addressed cells.

An important part for designing waveforms for driving the PDP is a reset waveform. A reset waveform of conventional AC PDPs and a corresponding driving method will now be described.

The reset period erases the majority, and preferably all, of the wall charges formed by a previous discharge, and sets up the wall charges to fluently perform a next address discharge. The PDP has millions of cells, each of which has a slightly different discharge voltage. However, a respective cells' discharges are controlled using a single predetermined voltage, thereby causing many difficulties. In the reset period, it is very important to erase and reset the wall charges and to solve the difference of discharge voltage provided between the cells. The reset waveform includes a part for erasing the wall charges generated by a previous discharge, and a process for rearranging the wall charges to solve discharge voltage dispersion between the cells and easily perform addressing.

That is, the reset period represents a period for supplying a voltage in a predetermined format to easily perform an operation of a subsequent addressing period. A PDP with bad uniformity between the cells may stably display images according to an operation characteristic during this period.

The waveforms generally used for stable operation of a display with low uniformity between cells during the current reset period is a ramp waveform disclosed, for example, by U.S. Pat. No. 5,745,086 and shown in FIG. 3. The gentler the slope of the ramp waveform, the more stable a display with low uniformity between the cells is operated. The slope should be substantially below 15 V/us, and for stable operation, it is preferable to have a slope of about 1 to 2 V/us. When, for example, the voltage is 400V(volts), for a slope of about 1 V/us, twice 200 us, that is, 400 us is required, which is too much time. Accordingly, the waveform illustrated in FIG. 4, which is an improvement of the above waveform, is generally used. Referring to FIG. 4, the waveform is not formed into a ramp waveform until it has reached a desired voltage. The voltage is instantly modified by as much of a voltage that may not generate discharging in the discharge cells of the PDP is instantly modified, and a ramp waveform is applied after this.

A prior art PDP driver comprises a sustain waveform former and a ramp waveform former. The sustain waveform former includes switches for applying waveforms in the sustain period, and each switch is an element having a large capacity for storing a large current used during the sustain period and each is driven at a low voltage.

However, the ramp waveform former uses the high voltages that are used for the reset period, and includes a main path switch for cutting the ramp waveform former and the sustain waveform former. By cutting the ramp waveform former and the sustain waveform former, it is possible to thereby prevent the high voltage used for the reset period from being supplied to a large-capacity element for applying the waveforms of the sustain period, and it enables the use of cheap elements.

Rising and falling ramp switches of the ramp waveform former connect a capacitor positioned between a drain electrode and a gate electrode of an FET so as to apply a ramp waveform. A ramp waveform is, a gradually increasing or decreasing voltage waveform. Since a constant voltage flows between the drain and the gate because of the capacitor, a constant current flows between the drain and the gate. Accordingly, a voltage having a ramp waveform is supplied to a panel capacitor.

However, the PDP driving circuit separately uses a main path switch for preventing a high voltage for supplying a reset waveform from being supplied to a circuit for supplying sustain waveforms, and a falling ramp switch for supplying falling ramp waveforms to scan electrodes. The above-noted driving circuit with separate switches is not efficient when considering that the switches are expensive.

SUMMARY OF THE INVENTION

This invention provides a PDP driving circuit having a reduced number of switches.

This invention separately provides a PDP driving circuit which is less expensive to manufacture than conventional PDPs.

This invention separately provides a device for driving a PDP for arranging a plurality of scan electrodes and sustain electrodes in parallel for each display line, and arranging a plurality of address electrodes to be crossed with the scan electrodes and the sustain electrodes. The device has a first switch and a second switch which are coupled in series between a first voltage and a second voltage, a capacitor coupled between a contact point of the first switch and the second switch and a third voltage, a rising ramp switch coupled to the third voltage, for forming a constant current, and a main path switch coupled between the contact point of the first and second switches and another end of the rising ramp switch, for forming a constant current.

This invention separately provides a PDP comprising a first substrate and a second substrate, a plurality of scan electrodes and sustain electrodes that are arranged in pairs, a plurality of data electrodes that are arranged to be crossed with the scan electrodes and the sustain electrodes, a first switch and a second switch that are coupled in series between a first voltage and a second voltage, a capacitor that is coupled between a contact point of the first and second switches and a third voltage, a rising ramp switch for forming a constant current is coupled to the third voltage as a first end of the rising ramp switch, and a main path switch that is coupled between the contact point of the first and second switches and second end of the rising ramp switch, for forming a constant current.

The first voltage is a sustain voltage, the second voltage is a ground voltage, and the third voltage is a voltage high enough that a sum of the third voltage and the first voltage may uniformly redistribute wall charges of respective cells of the PDP.

The first and second switches, the rising ramp switch, and the main path switch are MOS transistors and each MOS transistor has a body diode. Although these and other switches discussed in this application are described as MOS transistors, they are not specifically limited to MOS transistors, and may include switches that perform the same or similar functions. Preferably, the switches have a body diode.

The rising ramp switch and the main path switch respectively include a MOS transistor having a gate and a drain between which a capacitor is coupled.

This invention separately provides a method for driving a PDP for arranging a plurality of scan electrodes and sustain electrodes in parallel for each display line, and arranging a plurality of address electrodes to be crossed with the scan electrodes and the sustain electrodes, by (a) charging, to a third voltage, a capacitor having a first end selectively coupled to a first voltage and a second voltage; (b) supplying the first voltage to the first end of the capacitor, and turning on a rising ramp switch for supplying a constant current to the scan electrode to make the potential of the scan electrode rise to the third voltage from the first voltage in a ramp waveform, the rising ramp switch being coupled between a second end of the capacitor and the scan electrode; (c) turning off the rising ramp switch, and supplying the second voltage to the first end of the capacitor to control the potential of the scan electrode to a fourth voltage; and (d) turning on a main path switch for supplying the constant current to the scan electrode to make the potential of the scan electrode gradually fall, the main path switch being coupled between the second voltage and the scan electrode.

In (a), a first switch coupled to the first voltage is turned on to quickly increase the potential of the scan electrode to the first voltage.

In (a), the current flows through a charge and discharge unit coupled to a contact point of a first switch and a second switch are coupled in series between the first and second voltages to quickly increase the potential of the scan electrode to the first voltage.

In (c), a second switch coupled to the second voltage is turned on to quickly decrease the potential of the scan electrode by the potential obtained by subtracting the first voltage from the maximum voltage of (b).

In (c), the current flows through a charge and discharge unit coupled to the contact point of a first switch and a second switch which are coupled between the first and second voltages to quickly decrease the potential of the scan electrode by the potential obtained by subtracting the first voltage from the maximum voltage of (b).

These and other features and advantages of this invention are described in, or are apparent from, the following detailed description of various exemplary embodiments of the systems and methods according to this invention.

BRIEF DESCRIPTION OF THE DRAWINGS

The accompanying drawings, which are incorporated in and constitute a part of the specification, illustrate various exemplary embodiments of the invention, and, together with the description, serve to explain the principles of the invention, wherein.

DETAILED DESCRIPTION OF THE PREFERRED EMBODIMENTS

In the following detailed description, a preferred embodiment of this invention is described and illustrates a best mode contemplated by the inventor(s) of carrying out this invention. As will be realized, this invention is capable of modification in various obvious respects, all without departing from the scope of this invention. Accordingly, the drawings and description are to be regarded as illustrative in nature, and not restrictive.

A PDP driving device and method according to preferred embodiments of the present invention will be described.

Figure 5:
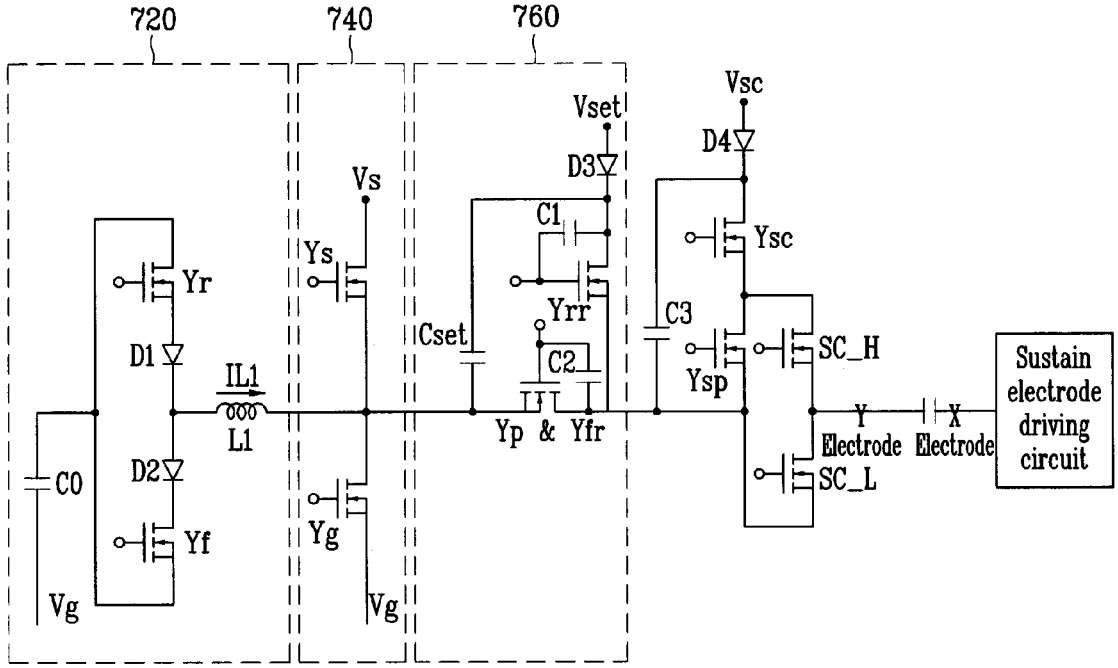
FIG. 5 shows a driving circuit of a scan electrode unit of a PDP according to the present invention.
Figure 6A:
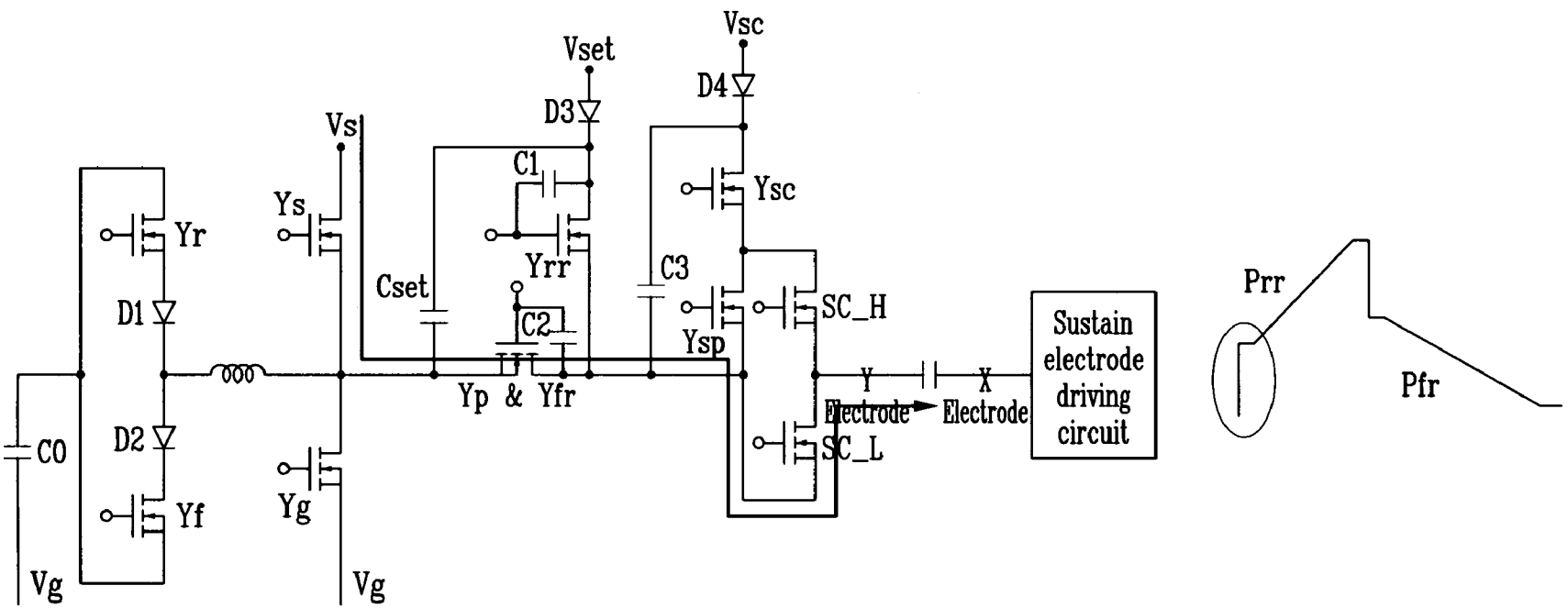
FIGS. 6(*a*) through 6(*d*) respectively show a current flow diagram and a driving waveform in the reset stage according to a PDP driving method according to the present invention.
Figure 6B:
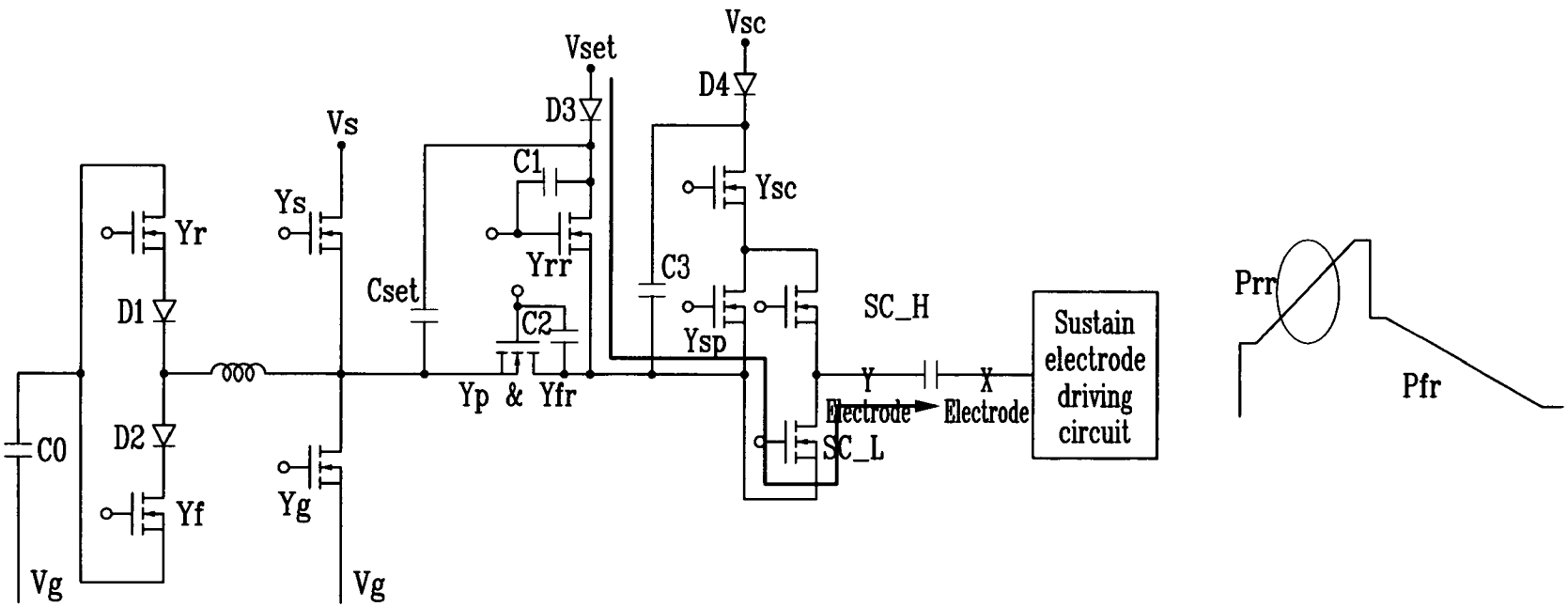
Figure 6C:
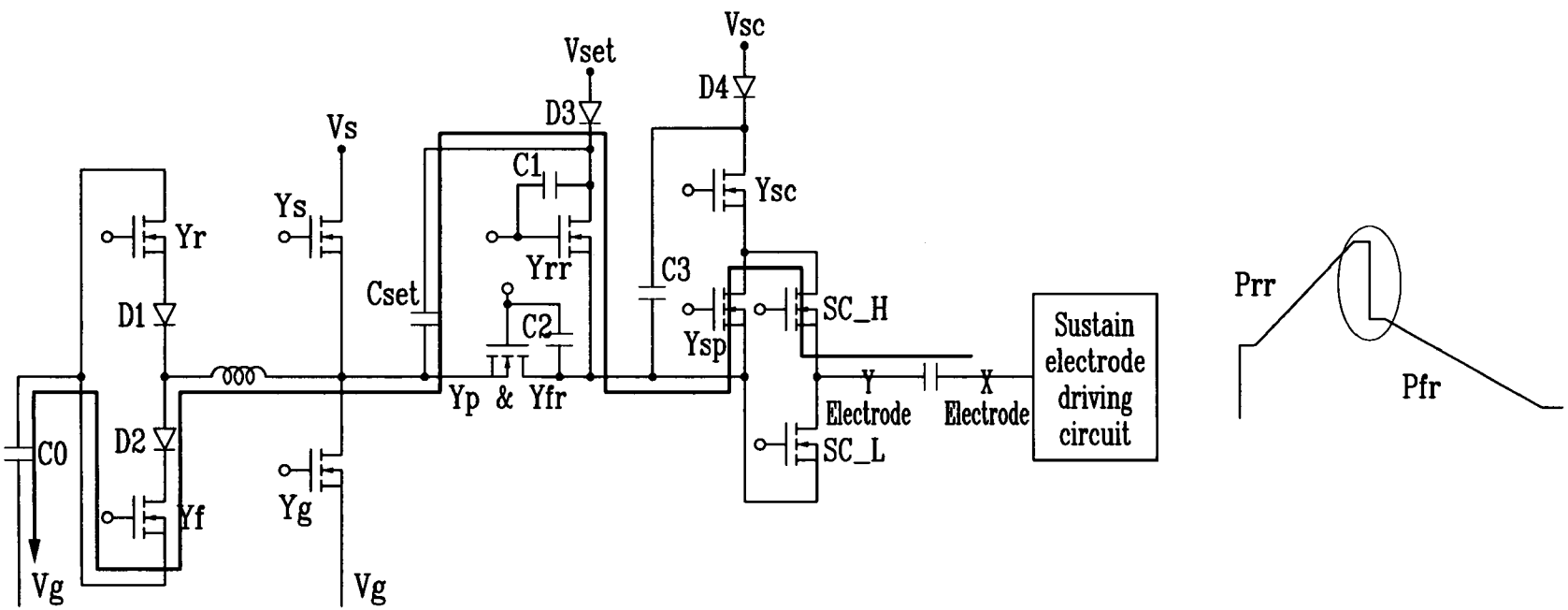
Figure 6D:
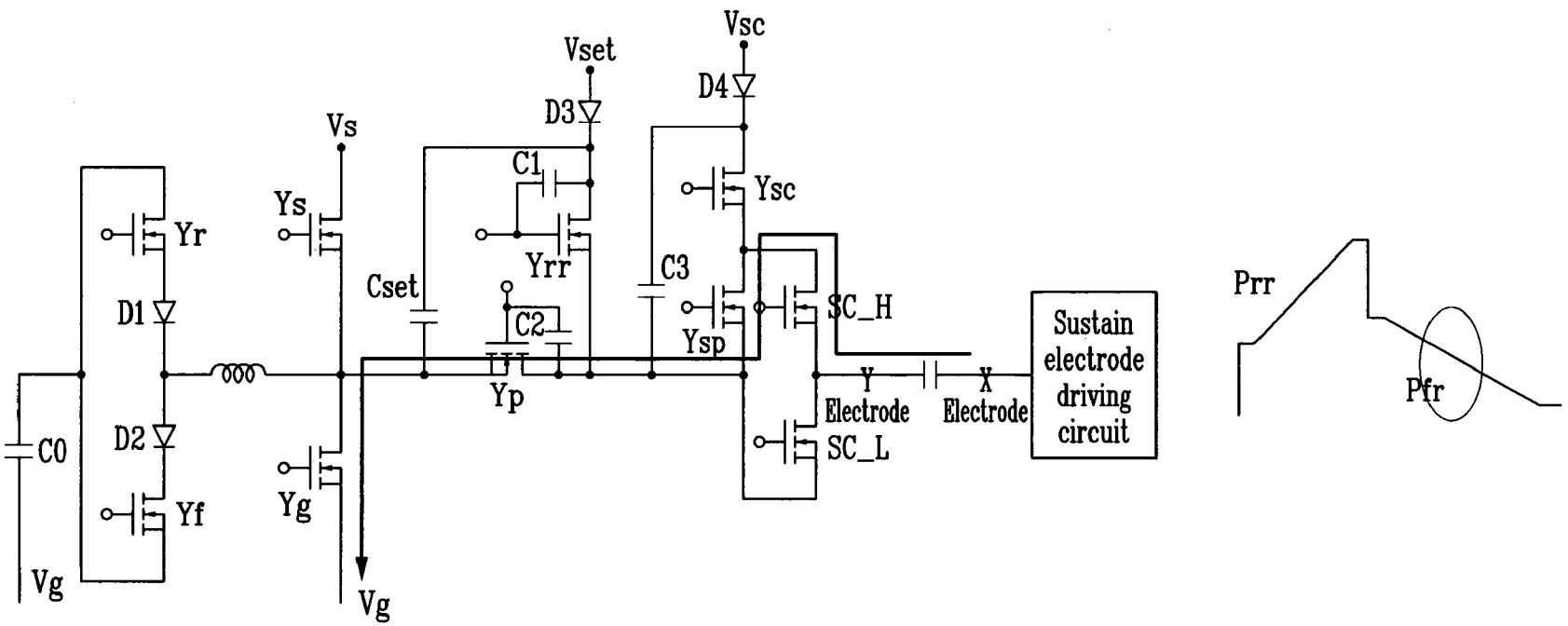

FIG. 5 shows a driving circuit of a scan electrode unit of a PDP according to a first preferred embodiment of the present invention. As shown, the driving circuit of the scan electrode unit of the PDP has a charge and discharge unit 720, a sustain unit 740, and a ramp waveform former 760.

The charge and discharge unit 720 comprises switches Yr and Yf, diodes D1 and D2, a capacitor C0, and an inductor L1. The voltage of Vs/2 is charged to the capacitor C0, and serial resonance between the inductor L1 and the panel capacitor C0 is used to make the potential of a scan electrode rise to the voltage of Vs or to make it fall to the voltage of Vg. The switch Yr is turned on to make the potential rise to the voltage of Vs, and the switch Yf is turned on to make the potential fall to the voltage of Vg. The diodes D1 and D2 set charge and discharge current paths.

The sustain unit 740 comprises voltages Vs and Vg, and switches Ys and Yg. The switches Ys and Yg are coupled in series between the voltages Vs and Vg, and a contact point between the switches Ys and Yg is coupled to the inductor L1. When the switch Ys is turned on, the potential of the scan electrode is sustained to be the voltage of Vs, and when the switch Yg is turned on, the potential of the scan electrode is sustained to be the voltage of Vg. The respective switches Ys and Yg comprise MOS transistors, and also include a body diode for preventing the potential of a contact point between a capacitor Cset and the switches Ys and Yg from being greater than Vs or less than Vg.

The ramp waveform former 760 comprises a rising ramp switch Yrr, a main path switch Yp & Yfr, and a capacitor Cset.

The rising ramp switch Yrr generates a rising ramp waveform which is a portion of a reset waveform. The rising ramp switch Yrr includes a MOSFET, has a gate and a drain between which a capacitor C1 is coupled, and has a body diode.

Yp & Yfr function as a main path switch for preventing a high voltage for supplying the reset waveform provided before addressing from being supplied to the sustain waveform former operable with a low voltage in the conventional PDP driving device. The main path switch Yp & Yfr also functions as a falling ramp switch for generating a falling ramp waveform which is a portion of the reset waveform. Therefore, the main path switch Yp & Yfr that is a MOSFET connects a capacitor C2 between a gate and a drain to form ramp waveforms, and it includes a body diode.

Figure 1:
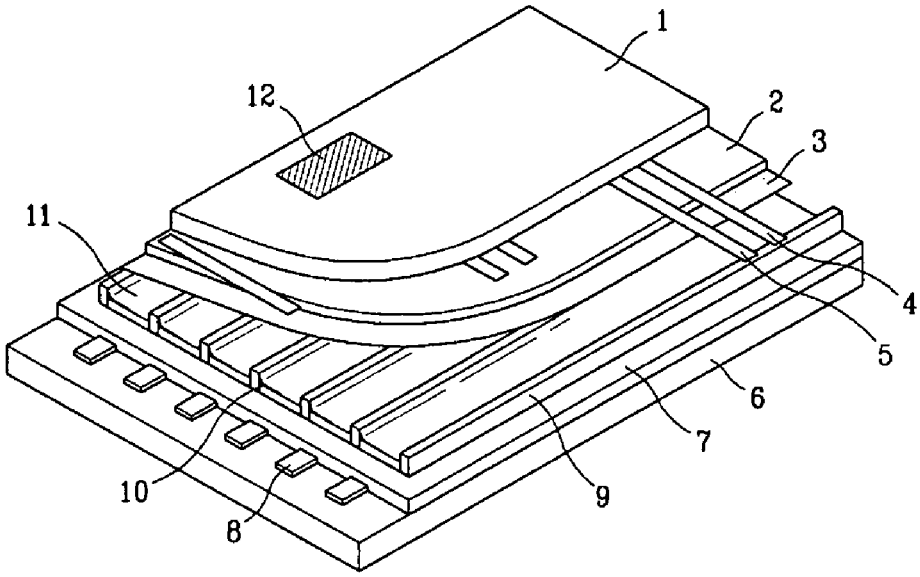
FIG.1(Prior Art)
FIG. 1 illustrates a partial perspective view of a conventional AC PDP.
Figure 2:
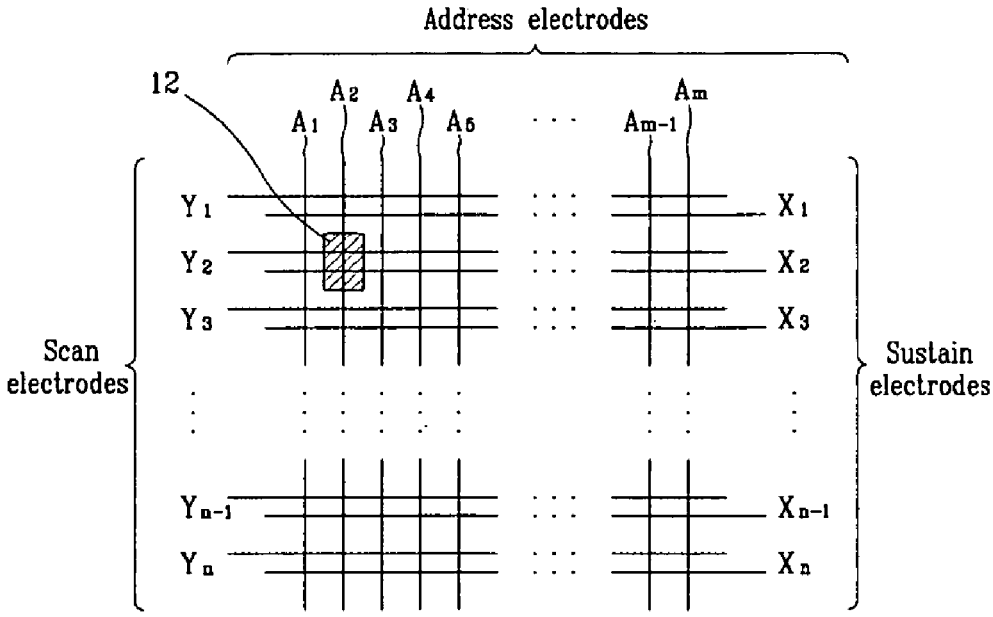
FIG.2(Prior Art)
FIG. 2 illustrates an electrode arrangement diagram of a conventional PDP.
Figure 3:
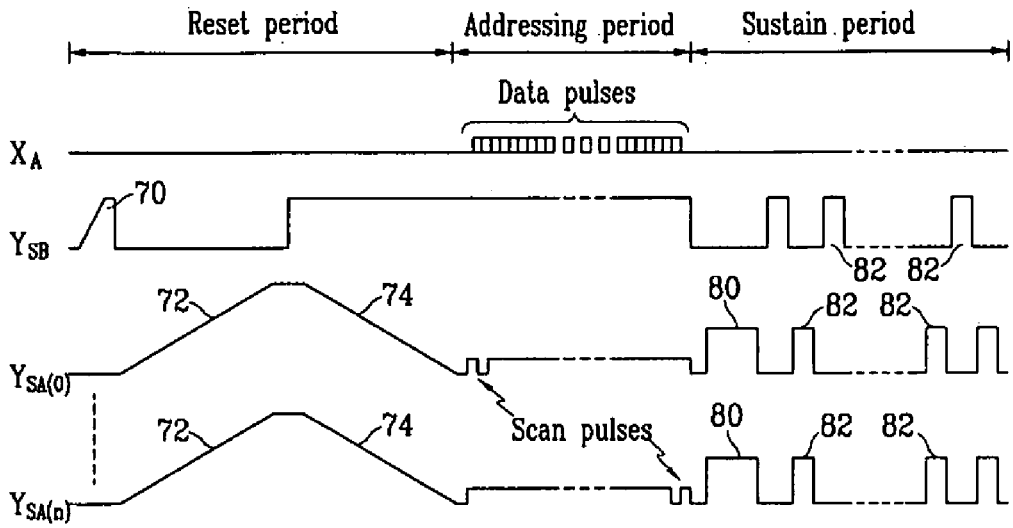
FIG.3(Prior Art)
FIGS. 3 and 4 respectively show a driving waveform of a conventional PDP.
Figure 4:
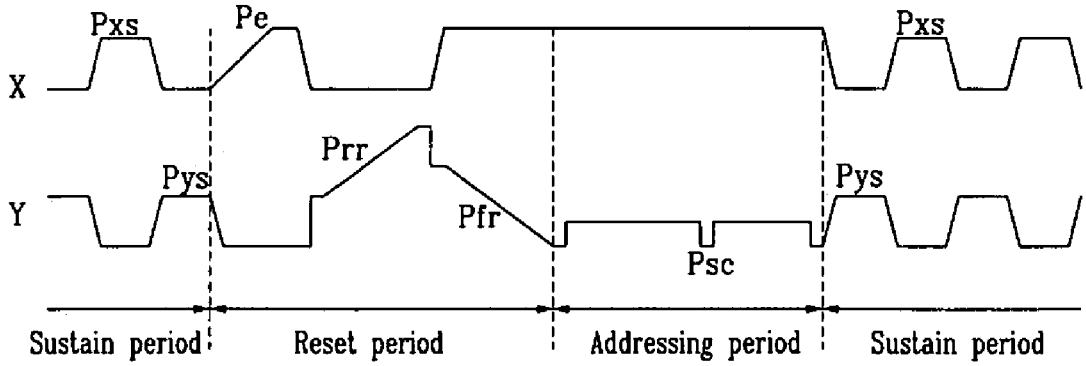
FIG.4(Prior Art)

The capacitor Cset coupled between the voltage Vset and the switch Yg controls the maximum voltage of the reset waveform, shown in FIG. 4, to be a sum of Vs and Vset. When the scan electrode is at the ground voltage Vg, the capacitor Cset is charged to the voltage of Vset. Thus, when the switch Ys is turned on, the voltage at a node coupled to the capacitor Cset and the voltage Vset becomes the sum of Vs and Vset. In the actual case, however, the voltage at the node may be a little less than the sum of Vs and Vset because of a parasitic component in the circuit.

Switches Ysc, SC_H, and SC_L and a capacitor C3 supply a scan voltage Vsc to the scan electrode. When the switches Ysc and SC_H are turned on, the scan voltage Vsc is applied to the scan electrode, and when the switch SC_L is turned on, the scan electrode is sustained to be a ground potential.

A switch $Y_{sp}$ flows the current to the sustain unit from the scan electrode.

Referring to FIGS. 6(*a*) through 6(*d*), a PDP driving method according to the first preferred embodiment this invention will now be described.

FIGS. 6(*a*) through 6(*d*) respectively show a current path in each mode and a corresponding reset waveform according to the first preferred embodiment of this invention.

In the first preferred embodiment of this invention, the switch Yg is turned on before the first mode starts, and accordingly, the potential at the scan electrode becomes the ground voltage Vg. Therefore, the voltage at the capacitor Cset is Vset.

(1) First Mode (Refer to FIG. 6(*a*).)

In the first mode, the switch Yg is turned off, and the switches Ys and SC_L are turned on. Accordingly, a current path that flows from the switch Ys, to the body diode of the main path switch Yp & Yfr, and to the switch SC-_L is formed. The potential at the scan electrode quickly rises to the voltage of Vs. Hence, as the voltage at one end of the capacitor Cset quickly rises to Vs from Vg since the voltage at the capacitor Cset was initially Vset, the voltage at another end of the capacitor Cset instantly rises to the voltage of (Vset+Vs) from the voltage of Vset.

In another way, when turning on the switch Yr of the charge and discharge unit instead of turning on the switch Ys of the sustain unit in the first mode, the potential at the scan electrode may be increased to Vs, and the switch Ys may then be turned on.

(2) Second Mode (Refer to FIG. 6(*b*).)

When the switch Ys is turned off, and the rising ramp switch Yrr and the switch SC_L are turned on, a current path flowing from the rising ramp switch Yrr to the switch SC_L is formed. A constant voltage is supplied to a gate and a drain of the rising ramp switch Yrr because of the capacitor C1 coupled between the gate and the drain of the rising ramp switch Yrr. Therefore, the constant current flows to the rising ramp switch Yrr, and the potential at the scan electrode gradually increases to the voltage of (Vset+Vs) in a ramp waveform Prr according to the influence of the panel capacitor. However, it fails to accurately reach the voltage of (Vset+Vs) but reaches very close to it because of the parasitic component of the circuit.

(3) Third Mode (Refer to FIG. 6(*c*).)

When the rising ramp switch Yrr is turned off and the switches SC_H, Ysp, and Yf are turned on, the current flows according to a path flowing from the switch SC_H, to the switch Ysp, to the body diode of the rising ramp switch Yrr, to the capacitor Cset, and to the switch Yf. Accordingly, the potential at the scan electrode quickly falls by the voltage of Vs from the maximum voltage because the voltage at the end of the capacitor Cset coupled to the switch Yg instantly falls to the ground voltage Vg from the voltage of Vs and the voltage at the other end of the capacitor Cset accordingly and quickly falls by the voltage of Vs.

In another way, the voltage at the scan electrode may fall by keeping the switch Yf turned off and turning on the switch Yg instead of turning on the switch Yf to make the voltage at the scan electrode fall.

(4) Fourth Mode (Refer to FIG. 6(*d*).)

When the switch Yf is turned off and the main path switch Yp & Yfr and the switch Yg are turned on, the current flows according to the path in order of the switch SC_H, the switch Ysp, the switch Yp & Yfr, and the switch Yg, and accordingly, the potential at the scan electrode gradually falls to the ramp waveform Pfr. The main path switch Yp & Yfr is a MOSFET with a gate and a drain between which a capacitor is coupled, thereby the constant current flows, and the ramp waveform may be applied to the scan electrode.

Figure 7:
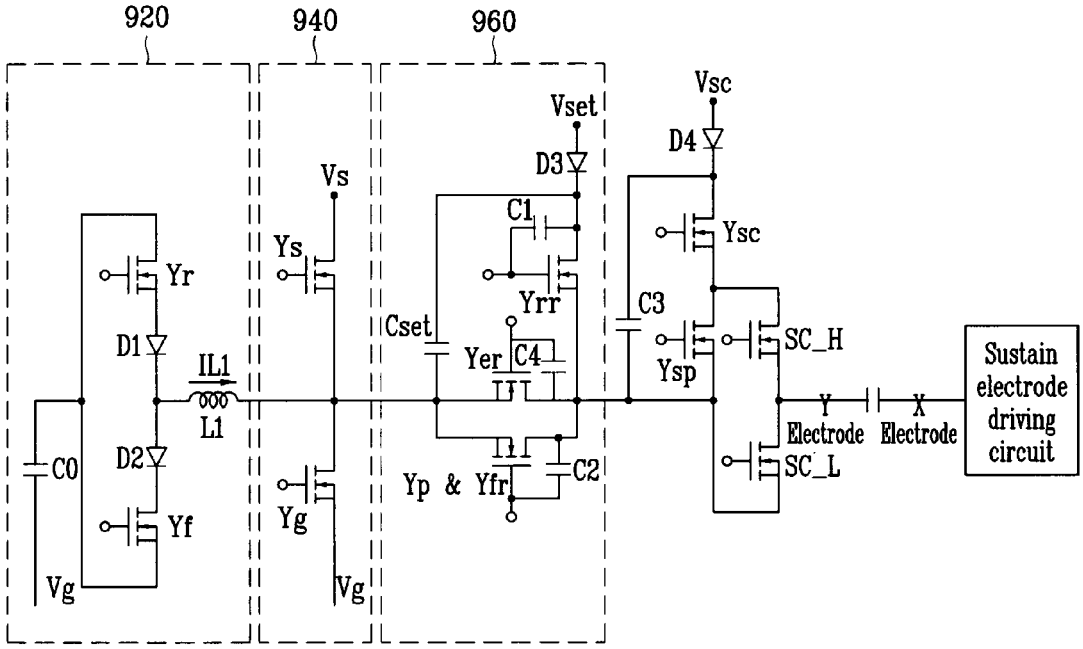
FIGS. 7 and 8 respectively show a PDP driving circuit and a driving waveform according to a second preferred embodiment of the present invention.
Figure 8:
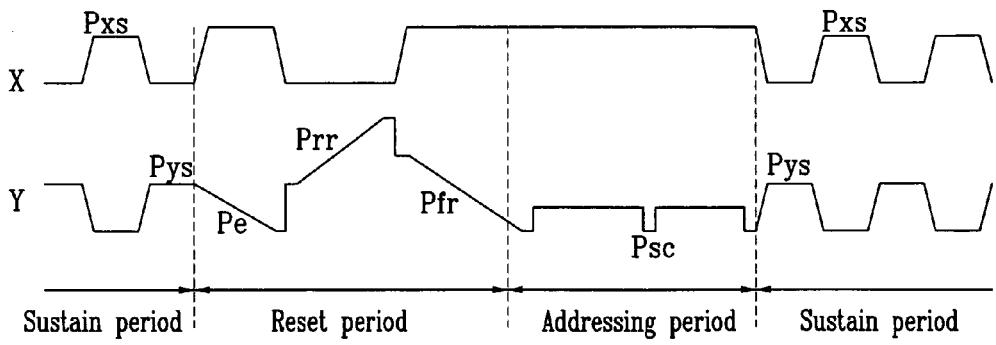
Figure 9A:
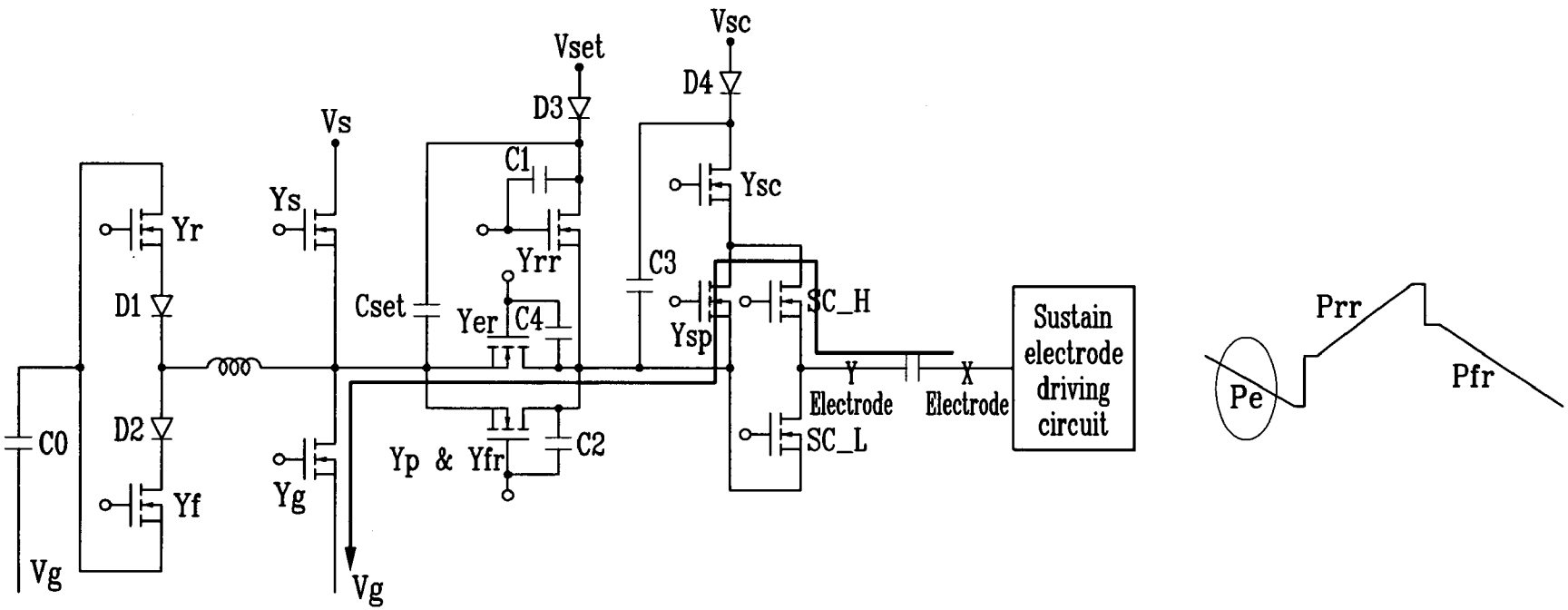
FIGS. 9(*a*) through 9(*e*) respectively show a current path of a mode and a corresponding reset waveform according to a second preferred embodiment of the present invention.
Figure 9B:
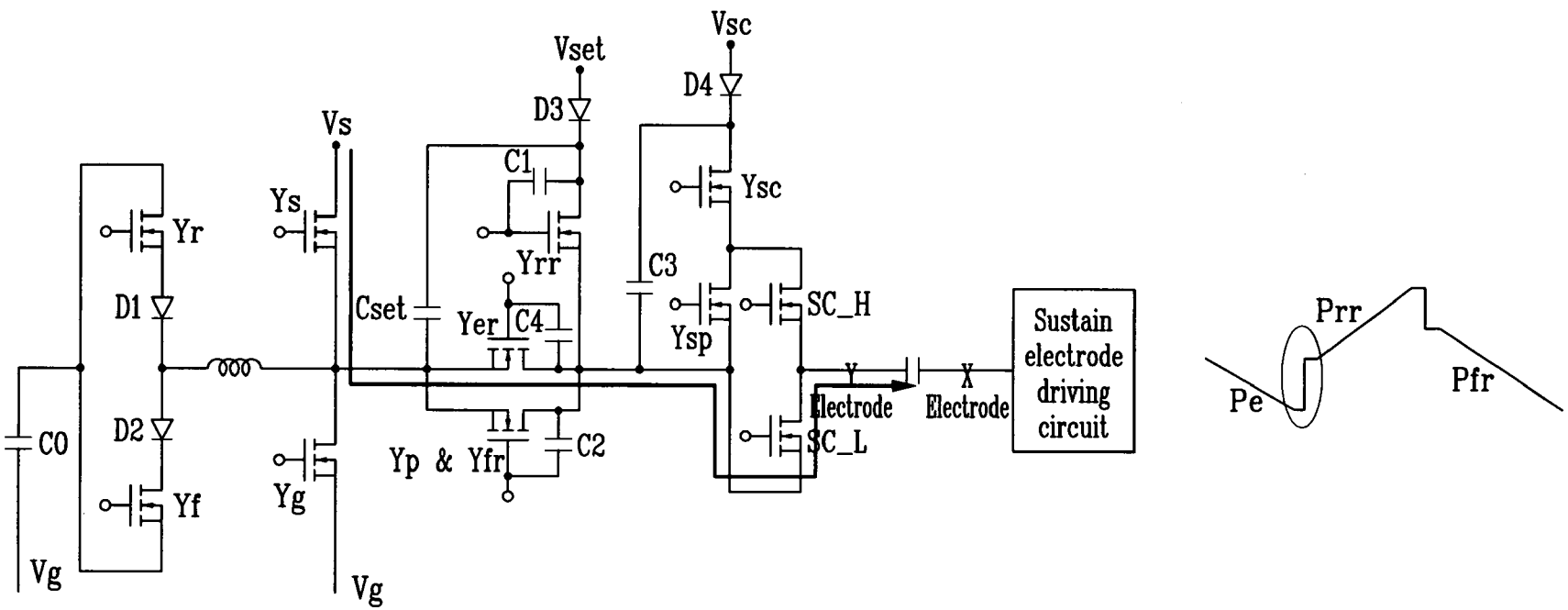
Figure 9C:
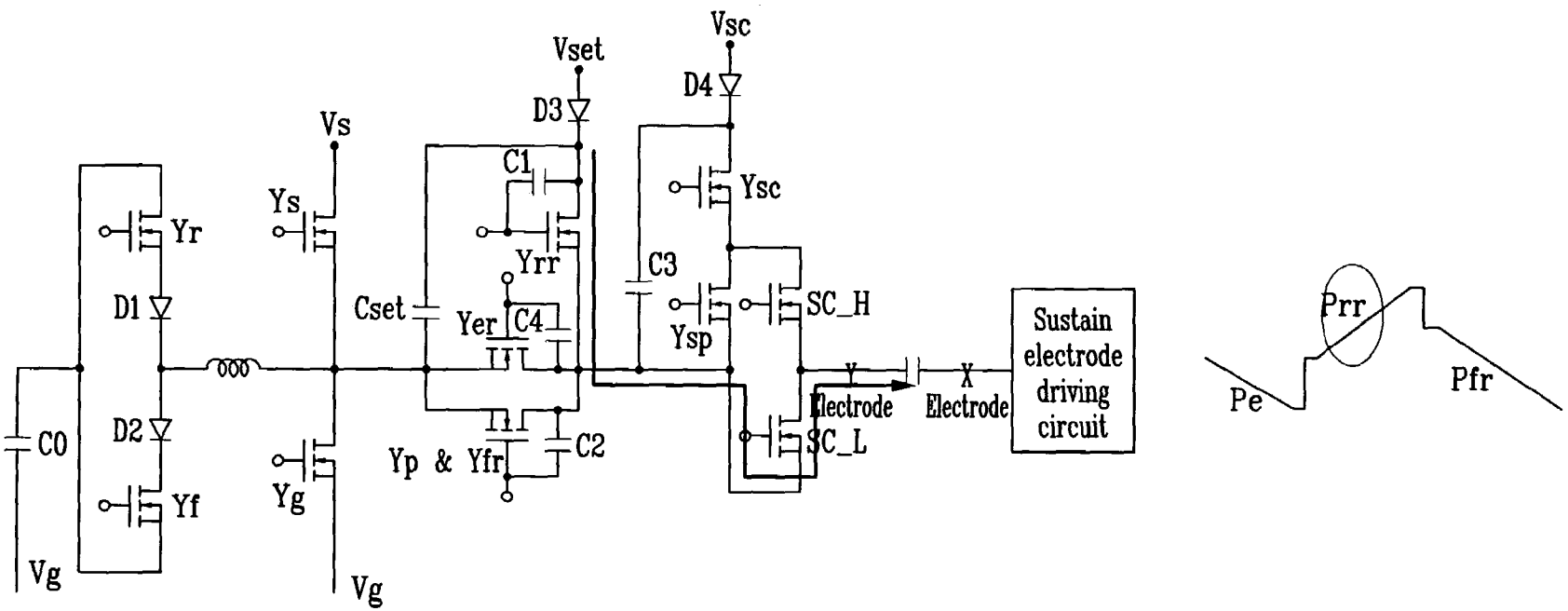
Figure 9D:
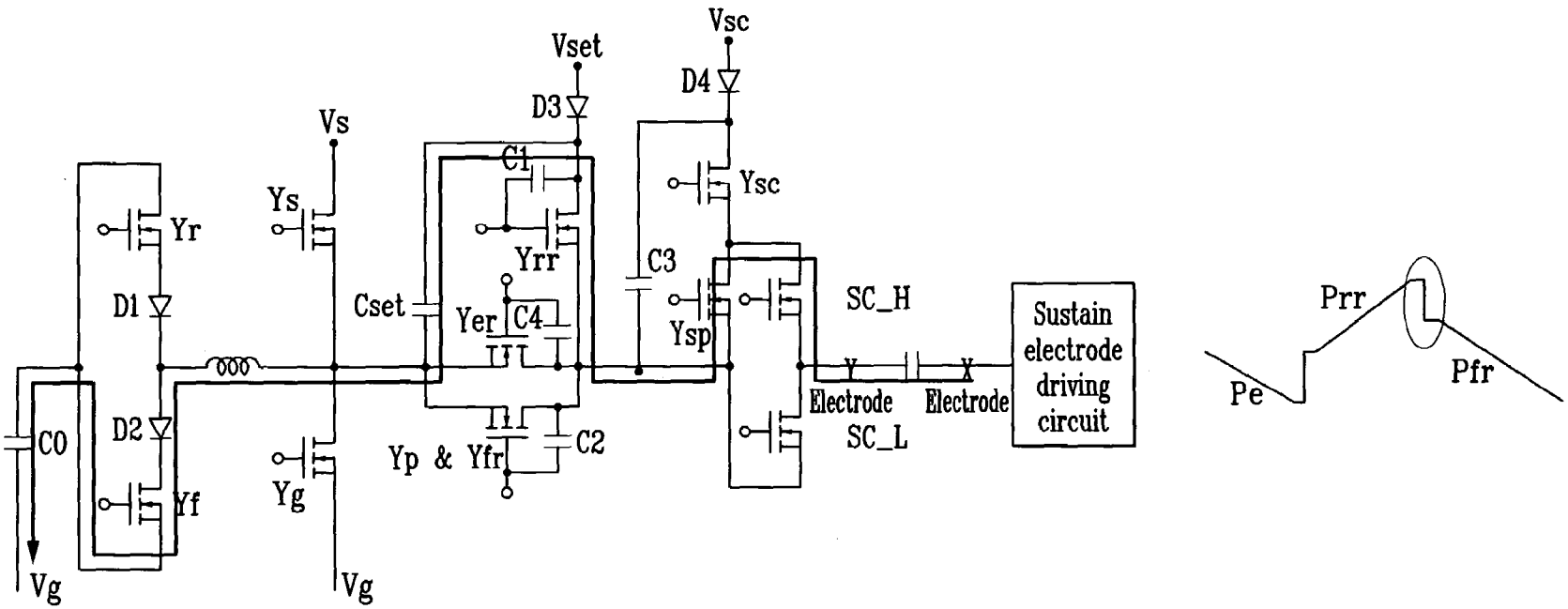
Figure 9E:
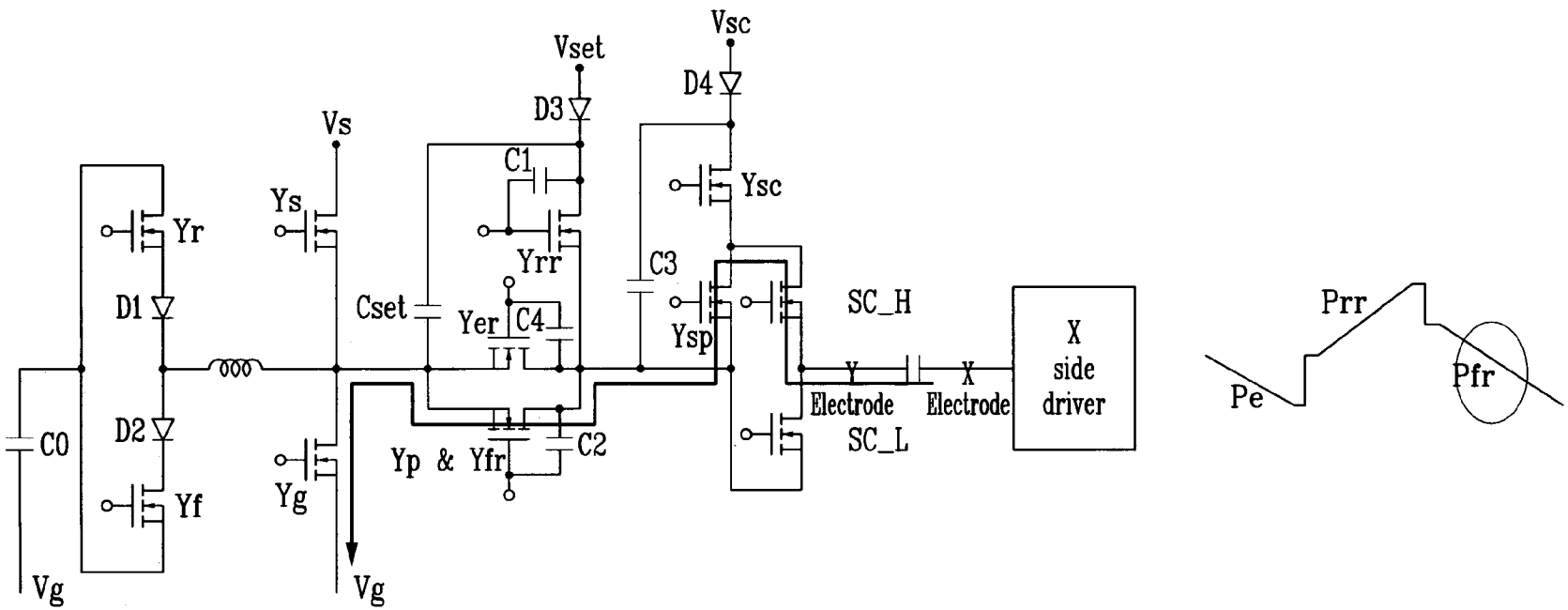

Referring to FIGS. 7 through 9(*e*), a second preferred embodiment of the present invention will now be described.

FIGS. 7 and 8 show a PDP driving circuit and a driving waveform according to the second preferred embodiment of the present invention.

The driving circuit according to the second preferred embodiment of the present invention comprises a charge and discharge unit 920, a sustain unit 940, and a ramp waveform former 960 in the like manner of the first preferred embodiment of the present invention. The driving circuit according to the second preferred embodiment of the present invention, further comprises a switch Yer. The switch Yer functions as an erase switch for applying an erase voltage waveform Pe to the scan electrode and erasing the wall charges caused by a previous discharge in each cell.

As shown in FIG. 7, the erase switch Yer is coupled between both ends of the main path switch Yp & Yfr and comprises a MOSFET with a gate and a drain, between which a capacitor is coupled, and a body diode. The erase waveform Pe of FIG. 8 is formed not with the main path switch Yp & Yfr but with the new erase switch Yer because the slopes of the ramp waveform change according to the characteristics of the capacitor coupled between the gate and the drain.

Referring to FIGS. 9(*a*) through 9(*e*), a PDP driving method according to the second preferred embodiment of the present invention will be described. FIGS. 9(*a*) through 9(*e*) respectively show a current path of each mode and a corresponding reset waveform according to the second preferred embodiment of the present invention.

(1) First Mode (Refer to FIG. 9(*a*).)

When the switch Ys is turned off and the erase switch Yer and the switches SC_H, Ysp, and Yg are turned on, the current flows according to a path in order of the switch SC_H, the switch Ysp, the erase switch Yer, and the switch Yg, and the potential of the scan electrode gradually falls in the ramp waveform Pe. The erase switch Yer includes a MOSFET having a gate and a drain between which a capacitor is coupled to flow the constant current, and accordingly, a ramp waveform is applied to the scan electrode under the influence of a panel capacitor.

(2) Second Mode (Refer to FIG. 9(*b*).)

In the second mode, the erase switch Yer and the switches Ysp and SC_H are turned off and the switches Ys and SC_L are turned on to form a current path in order of the switch Ys, the body diode of either the main path switch Yp & Yfr or the erase switch Yer, and the switch SC_L, and the potential of the scan electrode instantly rises to the voltage of Vs. Therefore, the voltage at the other end of the capacitor Cset instantly rises to the voltage of (Vset+Vs) from the voltage of Vset as the voltage at one end of the capacitor Cset instantly rises to the voltage of Vs from the ground voltage of Vg since the initial voltage at the capacitor Cset was the voltage of Vset.

In another way, the switch Yr of the charge and discharge unit may be turned on to make the voltage of the scan electrode rise to the voltage of Vs and turn on the switch Ys instead of directly turning on the switch Ys of the charge and discharge unit in the second mode.

(3) Third Mode (Refer to FIG. 9(*c*).)

When the switch Ys is turned off and the rising ramp switch Yrr is turned on, a current path is formed in order of the rising ramp switch Yrr and the switch SC_L. The constant voltage is supplied between the gate and the drain of the rising ramp switch Yrr because of the capacitor C1 coupled between the gate and the drain, and hence, the constant current flows to the rising ramp switch Yrr, and the potential of the scan electrode gradually increases to the voltage of (Vset+Vs) in the ramp waveform Prr according to the influence of the panel capacitor, but it does not accurately increase to the voltage of (Vset+Vs) but increases very close to it because of the parasitic component of the circuit.

(4) Fourth Mode (Refer to FIG. 9(*d*).)

When the rising ramp switch Yrr is turned off and the switches SC_H, Ysp, and Yf are turned on, the current flows to the path in order of the switch SC_H, the switch Ysp, the body diode of the rising ramp switch Yrr, the capacitor Cset, and the switch Yf, and accordingly, the potential of the scan electrode instantly falls by the voltage of Vs from the maximum voltage because the voltage at the end of the capacitor Cset coupled to the switch Yg instantly falls to the ground voltage Vg from the voltage of Vs and accordingly the voltage at the other end of the capacitor Cset instantly falls by the voltage of Vs.

Also, the switch Yf may stay turned off and the switch Yg may be turned on to make the voltage of the scan electrode fall instead of turning on the switch Yf to make the voltage of the scan electrode fall.

(5) Fifth Mode (Refer to FIG. 9(*e*).)

When the switch Yf is turned off and the main path switch Yp & Yfr and the switch Yg are turned on, the current flows to the path in order of the switch SC_H, the switch Ysp, the main path switch Yp & Yfr, and the switch Yg, and accordingly, the potential of the scan electrode gradually falls to the ramp waveform Pfr. Since the main path switch Yp & Yfr includes a MOSFET having a gate and a drain between which a capacitor is coupled, and the constant current flows to it, the ramp waveform is applied to the scan electrode according to the influence by the panel capacitor.

Therefore, the PDP driver according to the preferred embodiment of the present invention integrates the falling ramp switch Tfr and the main path switch Yp which configure a conventional PDP driving circuit into a main path switch Yp & Yfr as shown in FIG. 5, thereby reducing the number of switches.

According to the present invention, costs of the PDPs are lowered by reducing the number of switches used for the conventional PDP driving circuit.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A device for driving a PDP (plasma display panel) for arranging a plurality of scan electrodes and sustain electrodes in parallel for each display line, and arranging a plurality of address electrodes to be crossed with the scan electrodes and the sustain electrodes, the device comprising:

a first switch and a second switch coupled in series between a first voltage and a second voltage;

a capacitor coupled between a contact point of the first switch and the second switch and a third voltage;

a rising ramp switch for forming a constant current is coupled to the third voltage at a first end of the rising ramp switch; and a main path switch coupled between the contact point of the first and second switches and second end of the rising ramp switch, for forming a constant current and for generating a falling ramp waveform which is a portion of a reset waveform, wherein a current path for generating the falling ramp waveform includes the main path switch and the second switch, the second switch being a sustain unit switch.

2. The device of claim 1, wherein the first voltage is a sustain voltage, the second voltage is a ground voltage, and the third voltage is a voltage that is high enough that a sum of the third voltage and the first voltage may uniformly redistribute wall charges of respective cells of the PDP.

3. The device of claim 1, wherein the first and second switches, the rising ramp switch, and the main path switch are MOS transistors wherein each MOS transistor has a body diode.

4. The device of claim 1, wherein each of the rising ramp switch and the main path switch includes a MOS transistor having a gate and a drain between which a capacitor is coupled.

5. A method for driving a PDP (plasma display panel) for arranging a plurality of scan electrodes and sustain electrodes in parallel for each display line, and arranging a plurality of address electrodes to be crossed with the scan electrodes and the sustain electrodes, the method comprising:

charging, to a third voltage, a capacitor having a first end selectively coupled to a first voltage and a second voltage;

supplying the first voltage to the first end of the capacitor, and turning on a rising ramp switch for supplying a constant current to the scan electrode to make the potential of the scan electrode rise to the third voltage from the first voltage in a ramp waveform, the rising ramp switch being coupled between a second end of the capacitor and the scan electrode;

turning off the rising ramp switch, and supplying the second voltage to the first end of the capacitor to control the potential of the scan electrode to a fourth voltage; and turning on a main path switch for supplying the constant current to the scan electrode to make the potential of the scan electrode gradually fall, the main path switch being coupled between the second voltage and the scan electrode, wherein turning on the main path switch forms a current path including the main path switch and the second voltage, and generates a falling ramp waveform in the scan electrode, the second voltage being a sustain unit voltage.

6. The method of claim 5, wherein the first voltage is a sustain voltage, the second voltage is a ground voltage, the third voltage is a voltage high enough that the sum of the third voltage and the first voltage may uniformly redistribute wall charges of respective cells of the PDP, and the fourth voltage is the third voltage.

7. The method of claim 5, wherein charging, to a third voltage, a capacitor having a first end selectively coupled to a first voltage and a second voltage, comprises turning on a first switch coupled to the first voltage to supply the first voltage to the first end of the capacitor.

8. The method of claim 5, wherein supplying the first voltage to the first end of the capacitor, and turning on a rising ramp switch for supplying a constant current to the scan electrode to make the potential of the scan electrode rise to the third voltage from the first voltage in a ramp waveform comprises supplying the first voltage to the first end of the capacitor by having current flow through a charge and discharge unit coupled to a contact point of a first switch and a second switch coupled in series between the first voltage and the second voltage.

9. The method of claim 5, wherein turning off the rising ramp switch, and supplying the second voltage to the first end of the capacitor to control the potential of the scan electrode to a fourth voltage comprises turning on a second switch coupled to the second voltage to supply the second voltage to the first end of the capacitor.

10. The method of claim 5, wherein turning off the rising ramp switch, and supplying the second voltage to the first end of the capacitor to control the potential of the scan electrode to a fourth voltage comprises supplying the second voltage to the first end of the capacitor by having current flow through a charge and discharge unit coupled to a contact point of a first switch and a second switch coupled between the first voltage and the second voltage.

11. A plasma display panel (PDP), comprising:

a first substrate and a second substrate;

a plurality of scan electrodes and sustain electrodes arranged in pairs;

a plurality of data electrodes arranged to be crossed with the scan electrodes and the sustain electrodes;

a first switch and a second switch coupled in series between a first voltage and a second voltage;

a capacitor coupled between a contact point of the first and second switches and a third voltage;

a rising ramp switch coupled to the third voltage, for forming a constant current; and a main path switch coupled between the contact point of the first and second switches and another end of the rising ramp switch, for forming a constant current and for generating a falling ramp waveform which is a portion of a reset waveform, wherein a current path for generating the falling ramp waveform includes the main path switch and the second switch, the second switch being a sustain unit switch.

* * * * *